United States Patent [19]

O'Keeffe et al.

[11] Patent Number: 4,761,919

[45] Date of Patent: Aug. 9, 1988

[54] MULTIPLE SKYLIGHT GUTTERING SYSTEM

[75] Inventors: William F. O'Keeffe; Sonny Q. Garcia, both of San Francisco, Calif.

[73] Assignee: O'Keeffe's, Inc., San Francisco, Calif.

[21] Appl. No.: 44,156

[22] Filed: Apr. 30, 1987

[51] Int. Cl.[4] ..... E04D 13/00

[52] U.S. Cl. ..... 52/14; 52/200; 52/665

[58] Field of Search ..... 52/11–15, 52/200, 302, 665–669, 484, 475, 477, 395, 126, 5; 403/337, 346; 285/247; 220/81; 405/119–121

[56] References Cited

U.S. PATENT DOCUMENTS

| | | | |
|---|---|---|---|
| 837,767 | 12/1906 | Aims | 403/337 |
| 935,376 | 9/1909 | Lennon | 285/297 |
| 1,004,938 | 10/1911 | Thompson | 52/395 |
| 1,219,762 | 3/1917 | Osborn | 52/365 |
| 2,591,346 | 4/1952 | Fitzgerald | 403/346 |
| 2,669,097 | 2/1954 | Harris | 405/119 |
| 3,167,208 | 1/1965 | Proctor | 220/81 |
| 3,305,221 | 2/1967 | Kling | 52/475 |
| 3,310,922 | 3/1967 | Hoffman | 403/346 |
| 3,540,178 | 11/1970 | Altissimo | 52/669 |
| 3,611,731 | 10/1971 | Edmondson | 405/120 |
| 3,899,857 | 8/1975 | Mochizuki | 52/665 |
| 4,194,325 | 3/1980 | Chalpin | 52/14 |
| 4,211,400 | 7/1980 | Ray | 403/337 |

FOREIGN PATENT DOCUMENTS

| | | | |
|---|---|---|---|
| 188708 | 11/1922 | United Kingdom | 285/297 |
| 310576 | 5/1929 | United Kingdom | 220/81 |

*Primary Examiner*—James L. Ridgill, Jr.
*Attorney, Agent, or Firm*—Fliesler, Dubb, Meyer & Lovejoy

[57] ABSTRACT

A multiple skylight guttering system 20 includes a plurality of first channels 22 and a plurality of deeper second channels 24. The first channels 22 are received in appropriate apertures 42 of the second channels 24 with a securing mechanism 56 and a sealing mechanism 44 which does not require welding. The channels 22, 24 are received in apertures 86, 87 of a perimeter sill 32 using the same fastening mechanism 56 and sealing mechanism 44. The channels 22, 24 are mounted so that the channels can be sloped to afford appropriate drainage.

8 Claims, 6 Drawing Sheets

MULTIPLE SKYLIGHT GUTTERING SYSTEM

FIELD OF THE INVENTION

The present invention relates to a guttering system and in particular to a guttering system for use with a plurality of skylights configured together to form a roof.

BACKGROUND OF THE INVENTION

A number of modular skylight systems are commercially available. These skylight systems include a plurality of building blocks including individual skylights which are assembled together as required to form a roof structure. In effect, each of the skylights acts as a roof, and each requires some mechanism for draining rain which is collected over the surface area of the skylight. Generally, the drainage or guttering system is custom fabricated from stock channels at the job site. This custom fabrication requires equipment for on-site welding. It is to be understood that welding of such gutters and in particular aluminum gutters, on site, requires very heavy equipment and is a time consuming and expensive process. Accordingly, it is preferable that such welding be kept to a minimum and occur in a shop environment.

SUMMARY OF THE INVENTION

The present invention is directed to overcoming the disadvantages of the prior art.

The present invention includes a guttering system for draining fluid comprising a first plurality of first channels having a first cross-section and a second plurality of second channels having a second cross-section, the second channels being deeper than the first channels. The system further includes apertures defined on the second channels which are substantial in the shape of the first cross-section. Further, the system includes devices for securing the first channels in the first apertures of the second channel and seals for sealing between the first and second channels at the apertures.

The system further includes a peripheral sill provided with a plurality of second apertures substantially in the shape of the first cross-section and a plurality of third apertures substantially in the shape of the second cross-section. Further, the system includes means for securing and sealing first channels in the second apertures and second channels in the third apertures.

Accordingly, the present invention provides for a modular guttering system for use, for example, with a plurality of modular skylights which can be assembled to form a roof structure.

The guttering system can be assembled using a grid of shorter and shallower first channels which are intersected with deeper and longer second channels to form a matrix with other roofing components such as skylights positioned in the matrix. The first and second channels can be easily and quickly assembled without welding through the use of gaskets and a securing device which ensures that there is no leakage after the assemblage is completed. The channels are precut in the shop as are the gaskets so that only simple and quick assembly is required in the field. Further, the components are interchangeable so that no special ordering or instructions are required.

DETAILED DESCRIPTION OF THE PREFERRED EMBODIMENTS

Figure 1:
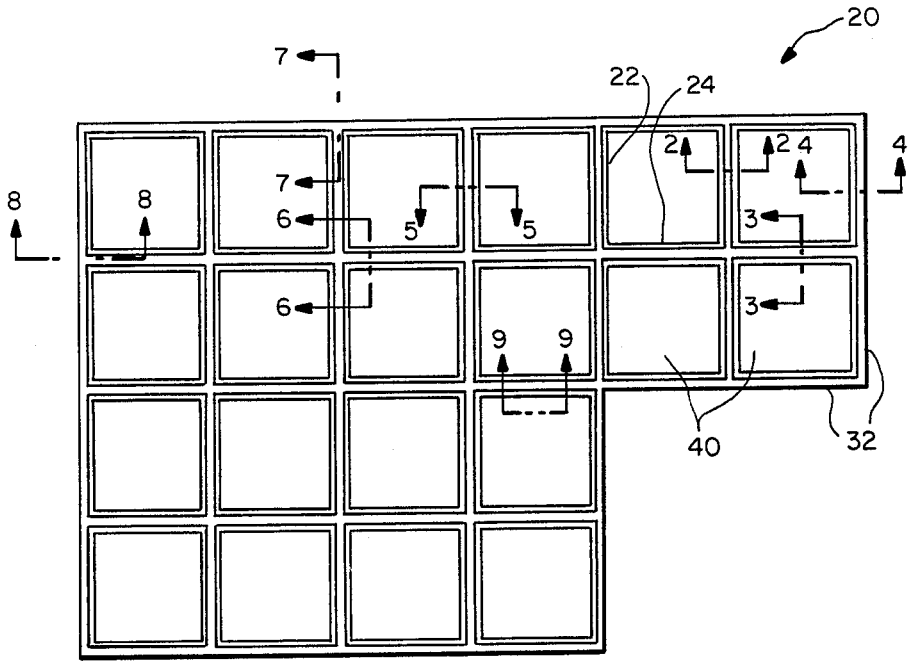
FIG. 1 is a plan view of a multiple skylight guttering system of the invention.
Figure 2:
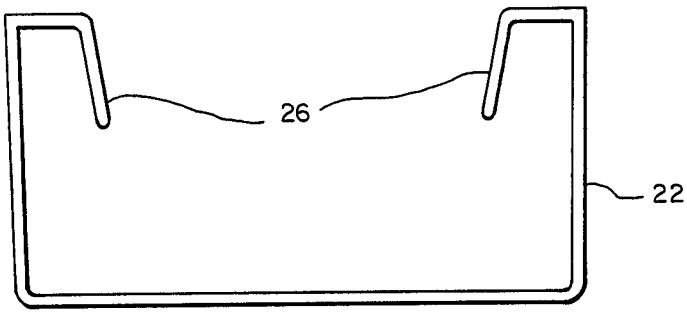
FIG. 2 is a cross-sectional view of a first shallow gutter taken through line 2—2 in FIG. 1.

With reference to the Figures and in particular to FIG. 1, a multiple skylight guttering system is depicted and identified by the numeral 20. System 20 is comprised of a plurality of first channels 22 (FIGS. 1, 2) and a plurality of second channels 24. First channels 22 are shallower than the deeper second channels 24. These channels 22, 24 in a preferred embodiment are comprised of extruded aluminum. Both channels 22 and 24 are substantially U-shaped in configuration and includes upper lips 26, 28. Deeper channel 24 additionally includes tabs 30.

Figure 4:
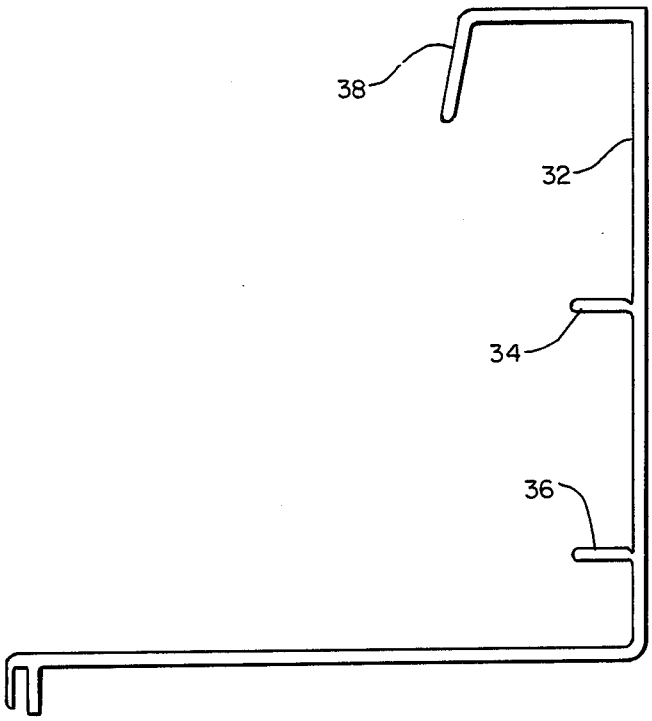
FIG. 4 is a cross-sectional view of a perimeter sill taken through line 4—4 in FIG. 1.

The system 20 further includes a perimeter sill 32 (FIG. 4). Perimeter sill 32 includes first and second tabs 34, 36. Further, perimeter sill 32 includes an upper lip 38.

Figure 5:
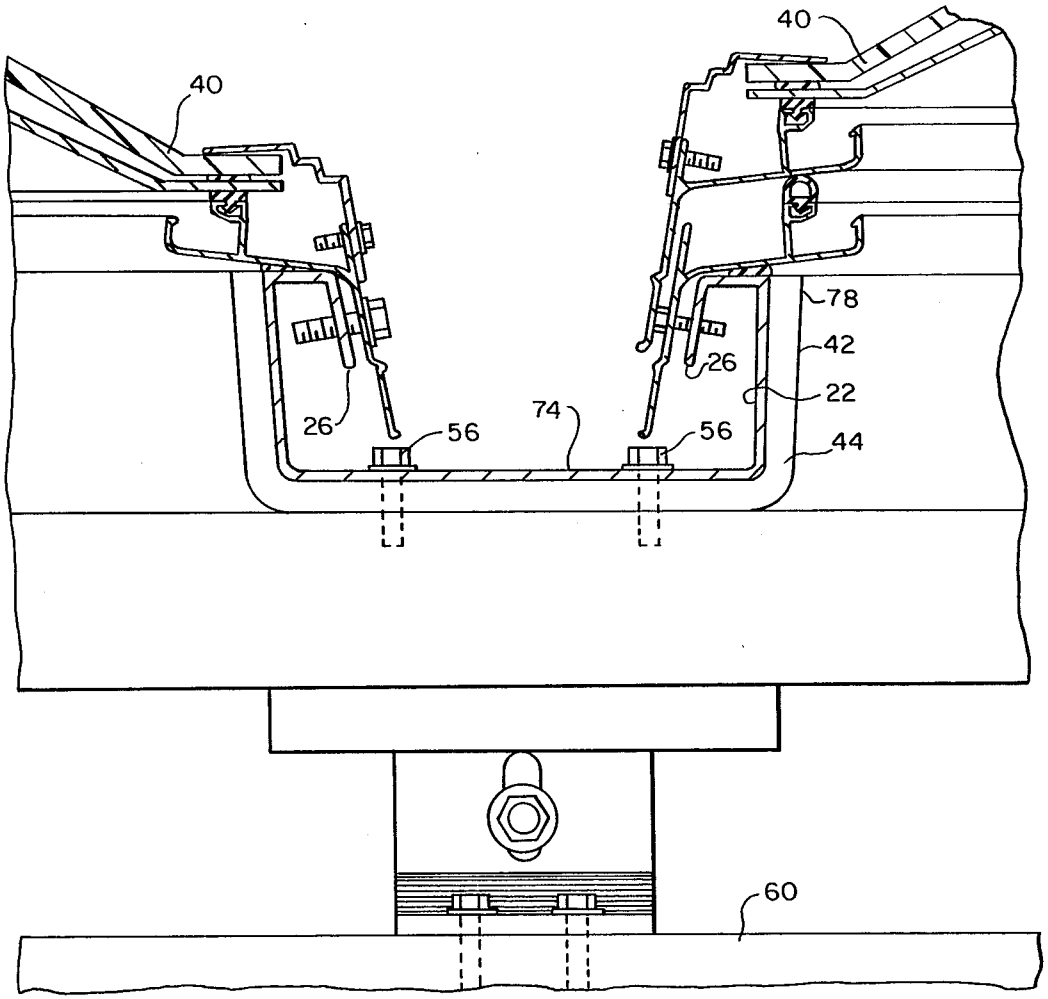
FIG. 5 is the intersection of a first shallow gutter with a second deeper gutter taken at line 5—5 in FIG. 1.
Figure 6:
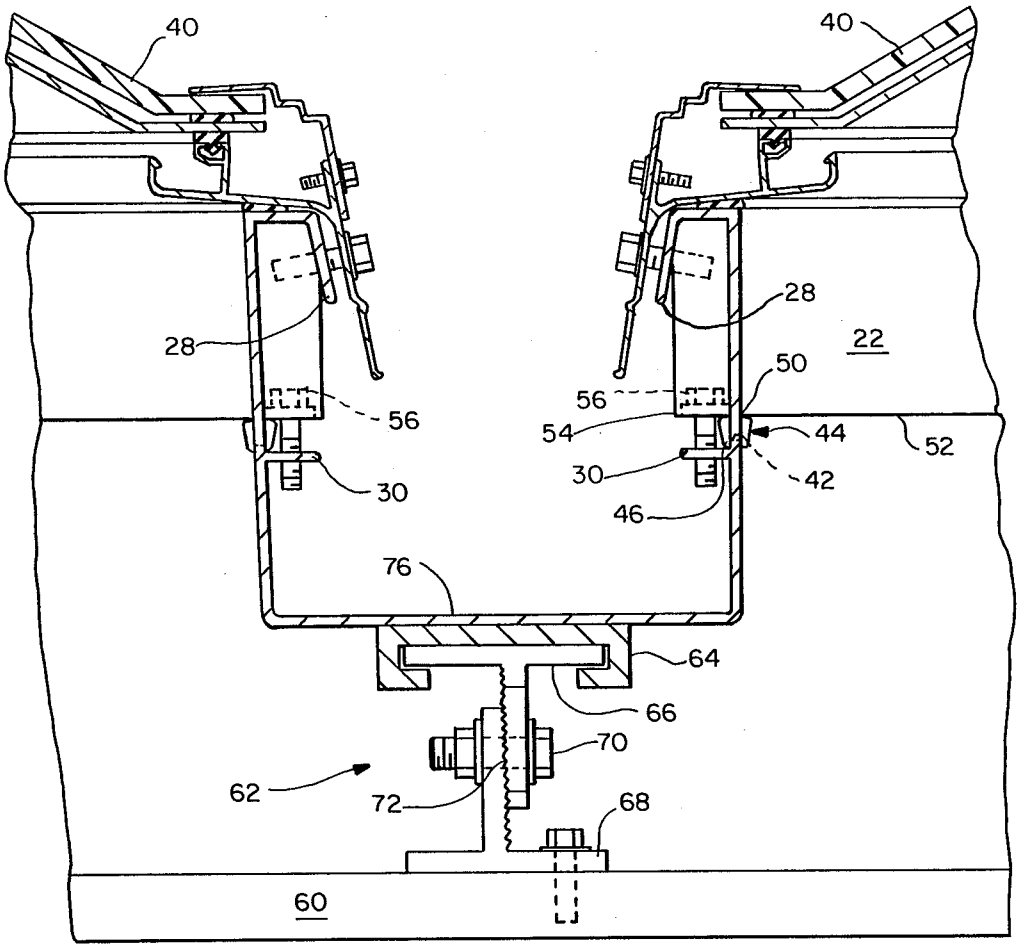
FIG. 6 is the intersection of a first shallow gutter and a second deeper gutter taken at line 6—6 in FIG. 1.

The multiple skylight guttering system 20 supports a plurality of skylights such as skylights 40. In the present depicted embodiment, all the skylights are of a square shape and include either a single or double glaze configuration. It is to be understood that skylights of other shapes including a mixture of various shapes, some square, some rectangular or triangular and the like can be combined together and are within the scope of the guttering system 20 of the invention. As can be seen in FIG. 5, second deeper channel 24 includes apertures such as aperture 42. This aperture is substantially U-shaped in cross-section and can receive therein the first shallower channel 22. A gasket 44, which in a preferred embodiment is an extruded gasket, is positioned between the first and second channels 22, 24 at the aperture 42 in order to provide a seal between the first and second channels. As can be seen in FIG. 6, gasket 44 has two downwardly extending legs 46, 48 and an upwardly extending concave surface 50. The legs 46, 48 straddle on either side of the edge of the aperture 42 with the concave surface 50 receiving the outer surface 52 of the first channel 22 with the first channel 22 positioned in the aperture 42. In a preferred embodiment, self tapping screws, such as screw 56, are used to secure the bottom of the first channel 22 to the tabs 30 of the second channel 24. With this arrangement, any leaking due to the above fastening mechanism would occur into the second channel. It is a further advantage that insulating and sealing substances (not shown) can be sprayed into the channels to cover and seal the channels including the above fastening mechanisms.

It is to be understood, that in a preferred embodiment, that the second channels 24 are generally long, running the length of the several skylights 40 which are to be assembled, while the first channels 22 are short, being only the length of an individual skylight. Accordingly, multiple first channels 22 extend from the longer, deeper second channels 24.

In a preferred embodiment, the second channels 24 are secured to a supporting structure 60 by a plurality of supports 62 which allow the slope of the second channels 24 to be adjusted in order to allow for proper water drainage. The support 62 include an anchor lug 64, an adjustable clip 66 and a base 68. The adjustable clip 66 and the base 68 are joined by a bolt 70. The positioning of the adjustable clip 66 with respect to the base 68 is accomplished by the serrations 72 defined by both the adjustable clip 66 and the base 68. The skylights 40 are secured to lips 26, 28 by appropriate means such as self-tapping screws as depicted in FIGS. 5 and 6. These skylights extend over the lips 26, 28 and into the cavities 74, 76 defined by the first and second channels 22, 24 respectively. Thus, water drains from the surface of the skylights directly into the cavities.

In a preferred embodiment, the U-shaped cross-section of the aperture 42 follows the U-shaped cross sectional outline of the first channel 22 except that the top of the aperture 42 at 78 is slightly narrower than the configurations of the U-shaped cross-section of the first channel 22. Thus, with the screws 56 holding the first channel 22 in place in the second channel 24, there is additional holding force placed between the upper portions of the first channel 22 and the top of the aperture 78. In other words, the upper opening of the U-shape that defines first channel 22 is the same as or slightly wider than the upper opening of the U-shaped aperture 42. Thus, the first channel 22 places additional pressure on gasket 44 and second channel 24, alleviating the need for applying screws such as screw 56, and tabs such as tab 30, adjacent the top of the aperture 78. Such a requirement would mean that the channels could not be extruded or that if extruded, additional welding steps would have to be performed in order to provide for tabs adjacent the top of the aperture 78.

Figure 7:
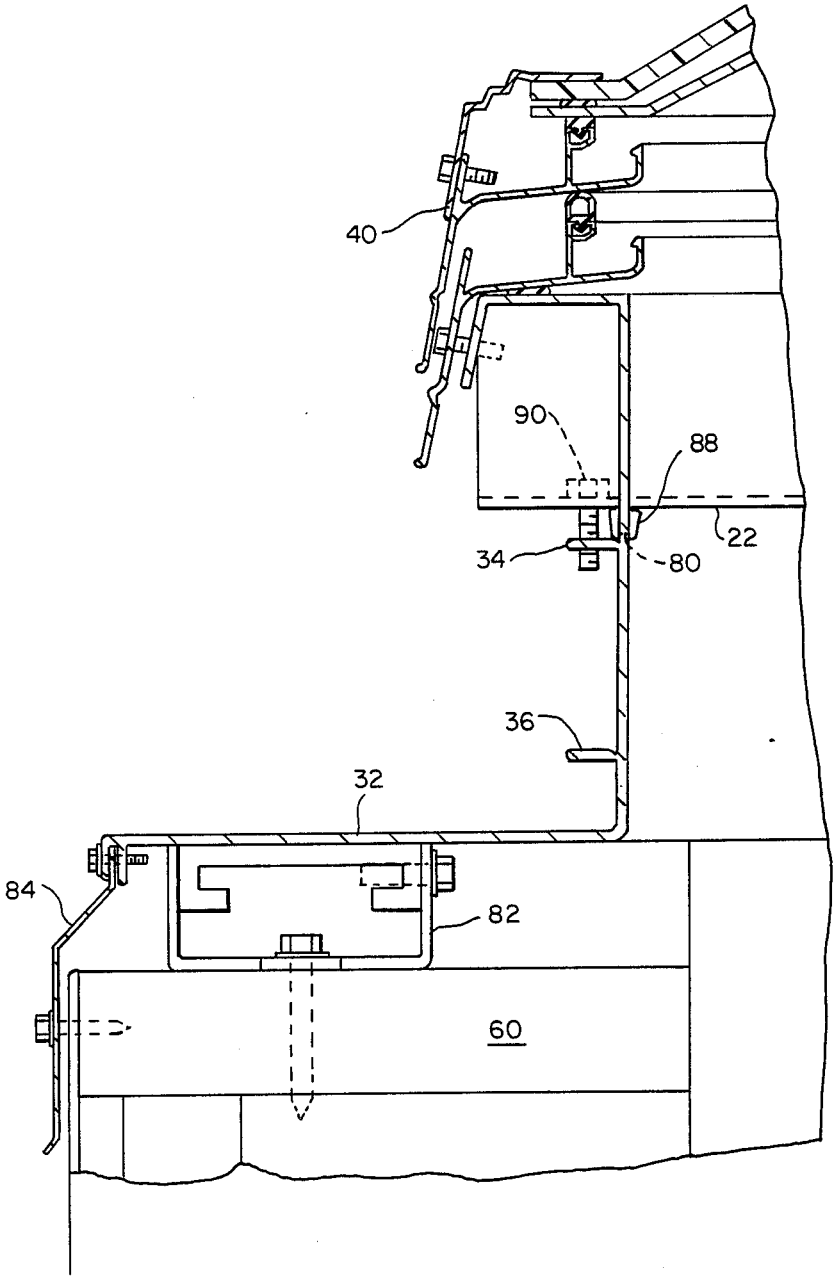
FIG. 7 is the intersection of a first shallow gutter at a perimeter sill taken at lines 7—7 in FIG. 1.

With respect to FIG. 7, a perimeter sill 80 is depicted. Perimeter sill 80 is secured to the support structure 60 by an appropriate bracket 82. Flashing 84 extends from sill 80 to protect the side of support structure 60. Perimeter sill 80 includes a plurality of apertures such as aperture 86 for receiving a plurality of first channels 22. Apertures 86 are similar in design and construction as apertures 42. Associated with apertures 86 are a plurality of gaskets 88 and screws 90 which function similar and in accordance with gasket 44 and screws 56 respectively. Thus, a plurality of first channels 22 can drain into peripheral sill 32. Skylights 40 are secured to the lip 38 of the peripheral sill 32 as seen in FIG. 7.

Figure 8:
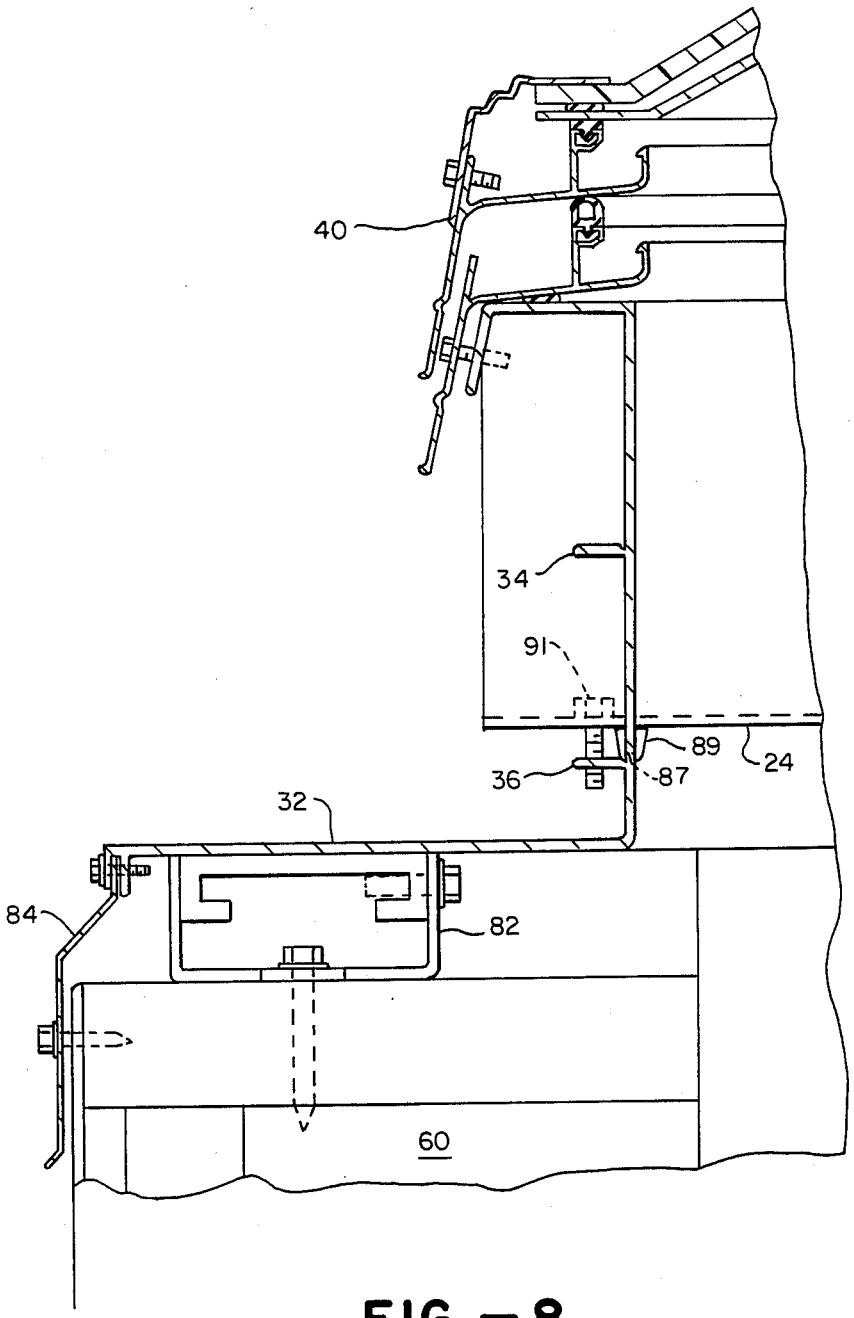
FIG. 8 is the intersection of a second deeper gutter at a perimeter sill taken at line 8—8 in FIG. 1.

FIG. 8 depicts an alternate location on the perimeter sill 32. At this location, perimeter sill 32 accepts the deeper second channels 24, gasket 89, screw 91 and aperture 87. In FIG. 8, screw 91 is affixed to tab 36 while in FIG. 7 the screw 90 was affixed to tab 34.

Figure 9:
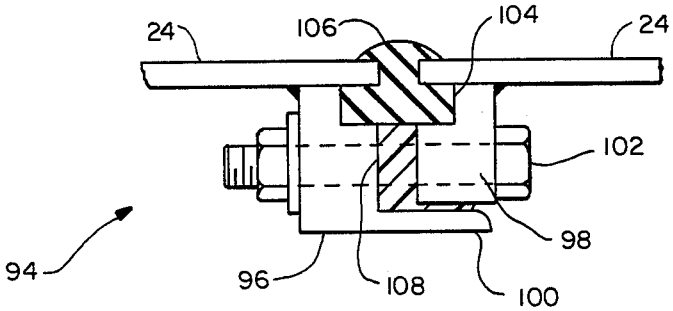
FIG. 9 is a cross sectional view of a mechanism for joining two gutters.
Figure 3:
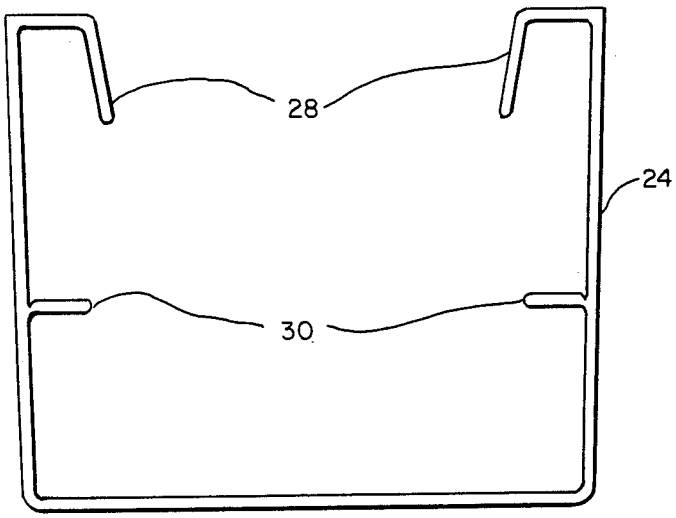
FIG. 3 is a cross sectional view of a second deeper gutter taken through line 3—3 in FIG. 1.

FIG. 9 depicts a fastener 94 for fastening together to second channels 24. It is to be understood that the same fastener can be used to secure together, if desired, first channels and perimeter sills. Fastener 94 includes first and second lugs 96, 98 which are welded to the channels 24. First lug 96 includes a splice sleeve 100 which extends over the second lug 98. An appropriate bolt is used to draw these two lugs 96, 98 together.

A first cavity 104 is defined between the two lugs and the channels 24. This cavity in a preferred embodiment receives an extruded gasket 106. The second cavity 108 is defined between the lugs 96, 98 and the splice sleeve 100. An appropriate sealant, such as a silicone sealant, is provided in this cavity prior to the tightening of the bolt 98 to secure the fastener 94.

Industrial Applicability

In a preferred embodiment, the system 20 is assembled in accordance with the mechanisms described hereinabove. It is to be understood that in a preferred embodiment the deeper channels 24 run in a first direction and the shallower channels 22 run in a direction which is perpendicular to the deeper channels 24. The perimeter sill 32 encloses the entire assemblage of first and second channels 22, 24. Water which is collected on the surface areas of the multitude of skylights 40 drains into the first and second channels and ultimately into the perimeter sill.

As is evident from the above description, the present invention provides for a guttering system 20 which eliminates or greatly reduces the need for using welding. In fact, the only areas still required for welding are at the corners of the structure. This minor amount of welding can be formed in a shop as required. The present structure allows for a quick, efficient construction of the system 20 using precut channels. The system can be quickly fastened together with the gaskets and self tapping screws so as to provide a water tight arrangement.

Other aspects and options of the invention can be learned from a view of the appended claims and the figures. It is to be understood that other embodiments of the present invention can be made and still come within the breath and scope of the invention.

I claim:

1. A guttering system for draining fluid comprising:

a plurality of first channels having a first cross-section;

a plurality of second channels having a second cross-section, the second channels being deeper than the first channels;

each of said second channels being provided with a plurality of first apertures substantially in the shape of the first cross-section;

first means for securing the first channels in the first apertures of the second channels;

first means for providing a seal between the first channels and the second channels with the first channels provided in the first apertures of the second channels;

a peripheral sill provided with a plurality of second apertures substantially in the shape of the first cross-section and a plurality of third apertures substantially in the shape of the second cross-section;

second means for securing the first channels in the second apertures and the second channels in the third apertures;

second means for providing a seal between the first channel and the peripheral sill with the first channels provided in the second apertures and for providing a seal between the second channels and the peripheral sill with the second channels provided in the third apertures;

wherein the first means for providing a seal includes first gaskets substantially conforming to the first cross-section;

wherein the second means for providing a seal includes second gaskets substantially conforming to the first cross-section and third gaskets substantially conforming to the second cross-section;

wherein said first gaskets in cross-section includes first and second appendages which fit about and form a pocket for receiving an edge of said first apertures of said second channels for forming a seal between the first gaskets and the first apertures, and a first surface for receiving said first channels against said first surfaces for forming a seal between the first surfaces and the first channels;

wherein said second gaskets in cross-section includes third and fourth appendages which fit about and form a pocket for receiving an edge of said second apertures of said peripheral sill for forming a seal between the second gaskets and the second apertures, and a second surface for receiving said first channels against said second surfaces for forming a seal between the second surfaces and the first channels; and wherein said third gaskets in cross-section includes fifth and sixth appendages which fit about and form a pocket for receiving an edge of said third apertures of said peripheral sill for forming a seal between the third gaskets and the third apertures, and a third surface for receiving said second channels against said third surfaces for forming a seal between the third surfaces and the second channels.

2. The system of claim 1 wherein said first channel is substantially U-shaped and has an upper opening and said first aperture is substantially U-shaped and has an upper opening with the upper opening of the U-shape of the first aperture being equal to or smaller than the upper opening of the U-shape of the first channel.

3. A guttering system for draining fluid comprising:

a plurality of first channels having a first cross-section;

a plurality of second extruded channels having a second cross-section, the second channels being deeper than the first channels;

each of said second channels being provided with a plurality of first apertures substantially in the shape of the first cross-section;

first means for securing the first channels in the first apertures of the second channels, said first securing means including a first tab extruded along the length of said second channels and positioned below said first apertures and first fastening means extending from the first channels for engaging said first tab with the first channels positioned in said first apertures of said second channels such that said first channels extend somewhat into said second channels;

first means for providing a seal between the first channels and the second channels with the first channels provided in the first apertures of the second channels;

an extruded peripheral sill provided with a plurality of second apertures substantially in the shape of the first cross-section and a plurality of third apertures substantially in the shape of the second cross-section;

second means for securing the first channels in the second apertures and the second channels in the third apertures, said second securing means includes (a) a second tab extruded along the length of said peripheral sill and positioned below said second apertures and (b) a third tab extruded along the length of said peripheral sill and positioned below said third apertures and (c) second fastening means extending from the first channels for engaging said second tab with the first channels positioned in said second apertures of said peripheral sill such that said first channels extend somewhat into said peripheral sill, and (d) third fastening means extending from the second channels for engaging said third tab with the second channels positioned in said third apertures of said peripheral sill such that said second channels extend somewhat into said peripheral sill;

second means for providing a seal between the first channels and the peripheral sill with the first channels provided in the second apertures and for providing a seal between the second channels and the peripheral sill with the second channels provided in the third apertures.

4. The system of claim 3 wherein:

said second channels define an internal cavity;

said first tab extends into said internal cavity;

said first channels, positioned in the first apertures, extend partially into the internal cavity; and said first fastening means is located in said internal cavity.

5. The system of claim 3 including means for adjusting the slope of the second channel.

6. The system of claim 3 including means for lockingly positioning the second channel in one of a plurality of positions.

7. The system of claim 3 including means for joining one second channel end-to-end to a another second channel.

8. The system of claim 7 wherein said joining means includes:

a first lug;

means for securing the first lug to said one second channel;

a second lug with a sleeve that slides over said first lug;

means for securing the second lug to said another second channel;

a cavity defined between the first lug and the second lug including the sleeve of the second lug;

means for urging the first and second lugs together;

a gasket positioned partially between said one second channel and said another second channel and partially in the cavity;

sealant positioned in said cavity adjacent said sleeve.

* * * * *